US006474010B1

(12) United States Patent
Hwang

(10) Patent No.: US 6,474,010 B1
(45) Date of Patent: Nov. 5, 2002

(54) PHOTOGRAPH ALBUM WITH MULTI-USE PAGES

(75) Inventor: Mikyung Hwang, Seoul (KR)

(73) Assignee: Euikwon Hwang, Santa Monica, CA (US)

( * ) Notice: Subject to any disclaimer, the term of this patent is extended or adjusted under 35 U.S.C. 154(b) by 87 days.

(21) Appl. No.: 09/670,323

(22) Filed: Sep. 27, 2000

Related U.S. Application Data

(60) Provisional application No. 60/178,279, filed on Jan. 27, 2000.

(51) Int. Cl.[7] ..... A47G 1/06

(52) U.S. Cl. ..... 40/776; 40/772; 40/773; 40/530; 40/765

(58) Field of Search ..... 40/771, 772, 773, 40/775, 776, 765, 530

(56) References Cited

U.S. PATENT DOCUMENTS

| | | | | | |
|---|---|---|---|---|---|
| 2,421,503 | A | * | 6/1947 | Hermon | 40/405 |
| 3,596,393 | A | * | 8/1971 | Lithgow | 40/704 |
| 3,651,591 | A | * | 3/1972 | Woodyard | 40/537 |
| 3,735,516 | A | * | 5/1973 | Wenstrom | 40/776 |
| 3,797,146 | A | * | 3/1974 | Holes | 40/536 |
| 4,065,864 | A | * | 1/1978 | Stanley | 40/530 |
| 4,106,230 | A | * | 8/1978 | Martinez | 40/530 |
| 4,635,796 | A | * | 1/1987 | Ozeki | 40/776 |
| 4,702,026 | A | * | 10/1987 | Shaine | 40/776 |
| 5,000,319 | A | * | 3/1991 | Mermelstein | 43/530 |
| 5,301,445 | A | * | 4/1994 | Hoffmeister | 40/530 |
| 5,480,192 | A | * | 1/1996 | Angerbauer et al. | 281/31 |
| 6,253,475 | B1 | * | 7/2001 | Ruebens | 40/530 |
| 6,266,907 | B1 | * | 7/2001 | Matteau et al. | 40/776 |

* cited by examiner

*Primary Examiner*—Lynne H. Browne
*Assistant Examiner*—James M. Hewitt
(74) *Attorney, Agent, or Firm*—Allen A. Dicke

(57) ABSTRACT

The multi-use photograph album pages of this invention are configured with three overlapping clear polymer panels secured to a central panel. The transparent panels are overlapped so that the top edges are exposed and open. Each of the polymer panels is attached at its left and right edges and its bottom edge. The bottom panel is attached all along its bottom edge while the top and middle polymer panels have left, central and right attachment points which act as stops. The stops position horizontally oriented photographs and permit vertically oriented photographs to stand therebetween. The page configuration thus accepts vertical or horizontal orientation without modification.

14 Claims, 5 Drawing Sheets

PHOTOGRAPH ALBUM WITH MULTI-USE PAGES

CROSS-REFERENCE

This application relies for priority on my earlier filed Provisional Application, Ser. No. 60/178,279, filed Jan. 27, 2000.

FIELD OF THE INVENTION

This invention is directed to a photograph album which has an opaque central panel and a plurality of transparent panels. The panels are permanently attached to the opaque central panel in specific locations so that photographs can be inserted and retained. The attachment is such that the photos may extend under several of the transparent panels so that photographs of different sizes and shapes can be accommodated.

BACKGROUND OF THE INVENTION

The photograph album is a well-known system for the storage and display of photographs. An album usually comprises a plurality of leaves within an outer cover. The leaves are configured to hold photographs in a display position. One type of photograph album holds the photos by adhesive on the page. The present invention is directed to the type of photo album in which the photos are slipped into a pocket for retention and display. The use of a transparent covering over the photographs protects them and can be employed to hold them in position. The problem is that there is a large number of different "standard" sizes of photographs. The size range has recently been increased by the availability of cameras which can produce panoramic or correspondingly tall photographs. Thus, there is a need for a photograph album of the pocket or slip-in type which is arranged so that the pages thereof can be used in a plurality of different ways to store photographs of different sizes and shapes.

SUMMARY OF THE INVENTION

In order to aid the understanding of this invention, it can be stated in essentially summary form that it is directed to a photograph album having pages which can be used to store and display photographs of different sizes and shapes. A page of the album has a usually opaque center panel. On the display side of the center panel at least two clear leaves are attached. The attachment points are positioned so that photographs of different sizes and shapes can be accommodated under the clear cover leaves.

It is thus a purpose and advantage of this invention to provide a photograph album which has pages therein where the pages are configured so that photographs of different sizes can be stored therein.

It is a further purpose and advantage to provide a photograph album where several clear leaves are positioned over the center panel so that in some cases smaller photographs can be inserted under each leaf, but the attachment of the leaves is such that one larger photograph may be inserted under several of the leaves.

It is a further purpose and advantage of this invention to provide a photograph album which is configured so that photographs of different size and shape can be stored and displayed on one of the album pages without the need for making configuration adjustments so that an individual can use the photograph album simply by slipping photographs under the clear leaves.

Other purposes and advantages of this invention will become apparent from a study of the following portions of this specification, the claims and the attached drawings.

DESCRIPTION OF THE PREFERRED EMBODIMENT

Figure 1:
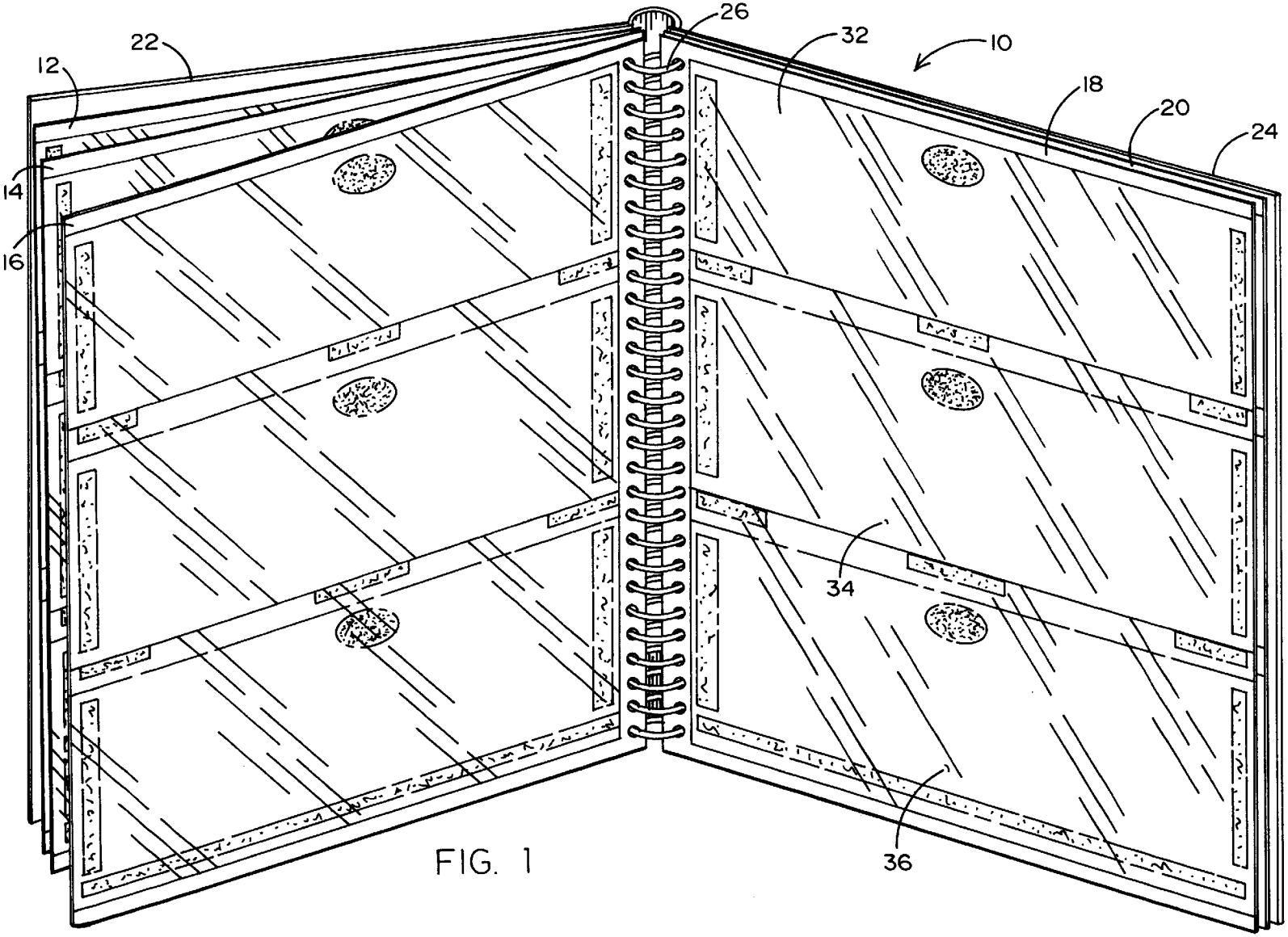
FIG. 1 is an isometric view of a photograph album in accordance with this invention.
Figures 2, 3:
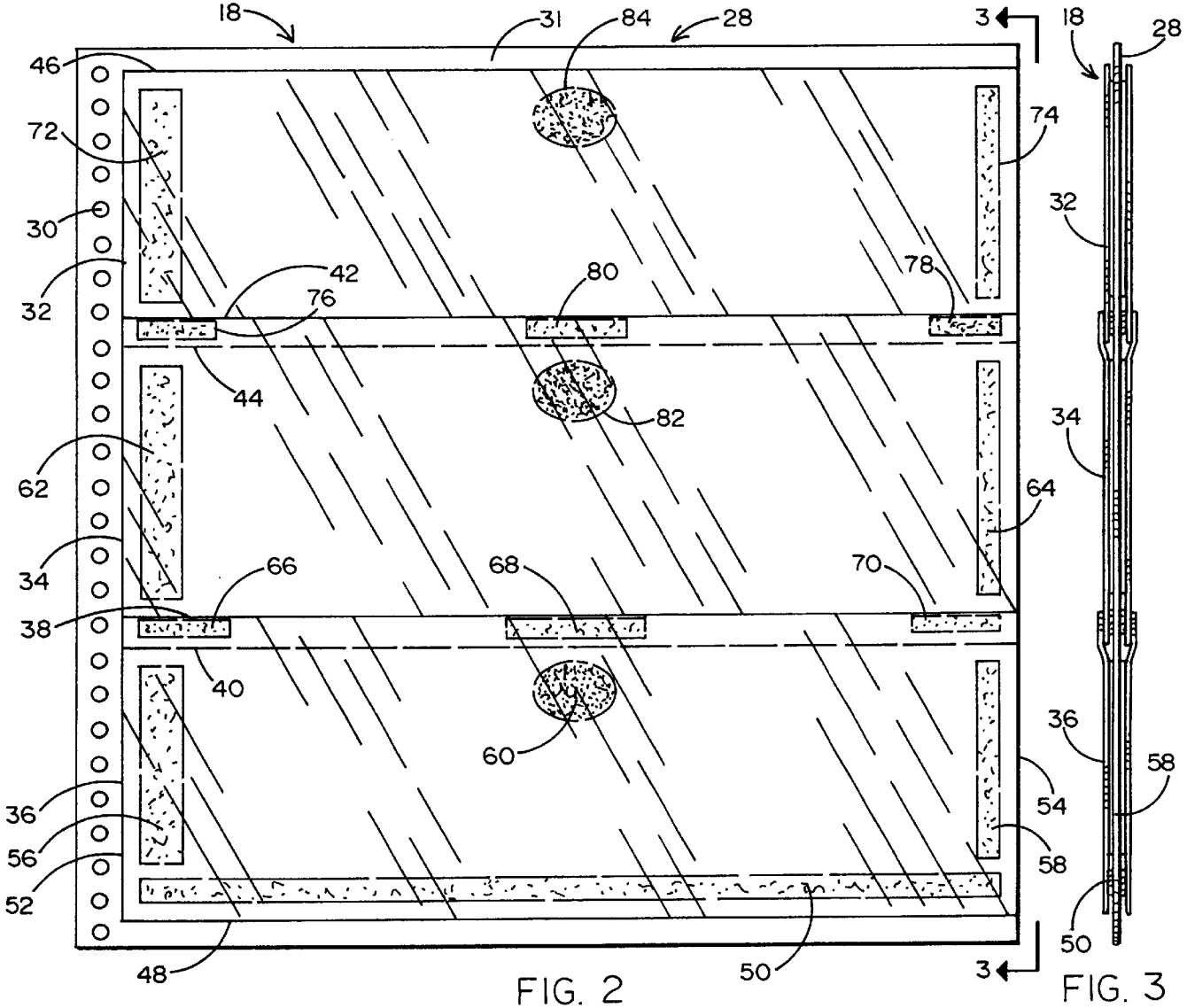
FIG. 2 is a plan view of one of the pages thereof.
FIG. 3 is an edge section taken generally along line 3—3 of FIG. 2.

The photograph album of this invention is generally indicated at 10 in FIG. 1. The photograph album comprises a plurality of pages, which may be identical. Pages 12, 14, 166, 18 and 20 are shown in FIG. 1. The album may have a front cover 22 and a back cover 24. The pages are preferably secured together by some kind of convenient binding, such as spiral binding 26. The binding may be the inserting of the separate pages into a ring binder. Alternatively, the pages may be secured together by conventional book binding, including gluing and sewing of the bound edges. This is attachment structure on the central panel for securing the pages together. Pages 12–20 are preferably identical and are preferably double-sided. Page 18 is shown in plan view in FIG. 2, and in section view in FIG. 3 and is illustrative of all the pages. Furthermore, each of the pages is preferably double-sided so that photos may be inserted into the pockets formed on each side of the page. This is true of page 18, which is shown in FIG. 3 as a section near the edge. Page 18 has a central panel 28 which extends to the left to include fastening holes 30 adjacent to the left edge. As stated above, the fastening holes may be arranged in different manners for different kinds of binding. The central panel is preferably a paper board stock, although it may be a sheet polymer composition material. It is stiff enough to support the photograph pockets. The front face 31 may be of any convenient color. In most cases, a light color is preferred so as to not distract from the photographs.

Three transparent synthetic polymer composition sheet material panels 32, 34 and 36 are attached to the face of the central panel in an overlapping position. The top edge 38 of panel 36 overlaps the bottom edge 40 of panel 34, with the lower panel 36 on the outside, see FIG. 2. The top edge 42 of panel 34 overlaps the bottom edge 44 of panel 32. The top edge 46 of panel 32 does not quite reach the top edge of the central panel 28 so that a small amount of the face 31 is exposed at the top edge. Similarly, the bottom edge 48 does not extend all the way to the bottom edge of the central panel 28, but some of the face 31 is exposed. However, it must be noted that the transparent panels 32, 34, and 36 all extend to the free edge, which is the edge opposite the fastening holes, of the central panel 28.

Each of the transparent panels is attached to the central panel 28. The bottom transparent panel 36 is attached to the central panel 28 adjacent its bottom by a long band of permanent adhesive 50. This band is close to the bottom of panel 36 and extends from left to right under the panel to closely adjacent its left and right edges 52 and 54. Adjacent to the left and right edges 52 and 54 are left and right bands 56 and 58 of permanent adhesive. These bands are slightly spaced from the lower band 50. These bands are close to the edges but are spaced slightly inward from the edges. This is to prevent exposed adhesive. The left of adhesive band 56 is slightly wider than the narrower right adhesive band 58. These adhesive bands permanently attach the panel 36 of the central panel 28 and leave an unattached top edge 38 for the insertion of photographs behind the transparent panel in the front of the central panel 28. In order to prevent the transparent panel from bulging out, adhesive dot 60 is applied behind the top center of transparent panel 36. The adhesive dot 60 is made of a pressure-sensitive adhesive but one which can be detached and reattached. It is not a permanent adhesive, but a detachable and reusable formulation of adhesive.

Transparent panel 34 is attached in much the same way. Thus, as seen in FIG. 3, the panel 34 is arranged so that it is overlapped at the bottom by panel 36. The top of panel 36 overlies the bottom edge of panel 34. Left and right attachments of the panel 34 to the center panel 28 by left edge of adhesive band 62 and right edge of adhesive band 64, which are the same as adhesive bands 56 and 58 in lateral position and size. Along its bottom, the panel 34 is attached by three separate short adhesive bands 66, 68 and 70. The left and right adhesive bands 66 and 70 are substantially under the left and right edge adhesive bands 62 and 64. They extend inward a short distance from the inside edge of the upright adhesive bands 62 and 64 to form a stop which extends inwardly a short distance respectively from the bands 62 and 64. The short band 68 is directly above the adhesive dot 60, and of similar width, to not occupy any additional lateral space. Thus, the bottom edge of panel 34 is not permanently attached along its full bottom edge, so that there is not a complete bottom stop at the bottom edge of panel 34.

Panel 32 is secured in a similar manner to panel 34. There are left and right permanent adhesive bands 72 and 74 and left and right adhesive band stops 76 and 78 and center stop 80. These are permanent adhesive attachments. The bands 76, 80 and 78 are respectively shorter than the bands 66, 68 and 70 to leave wider spaces therebetween as especially seen in FIG. 8. There are detachable adhesive dots 82 and 84, respectively, under the top center of the panels 34 and 32. This arrangement of adhesive attachment and overlap of the transparent panels permit utilization of the face of each page in a plurality of different ways. Furthermore, as seen in FIG. 3, the page 18 is double-sided so that each side has similar construction. Furthermore, each of the pages may be of double-sided construction.

Figure 4:
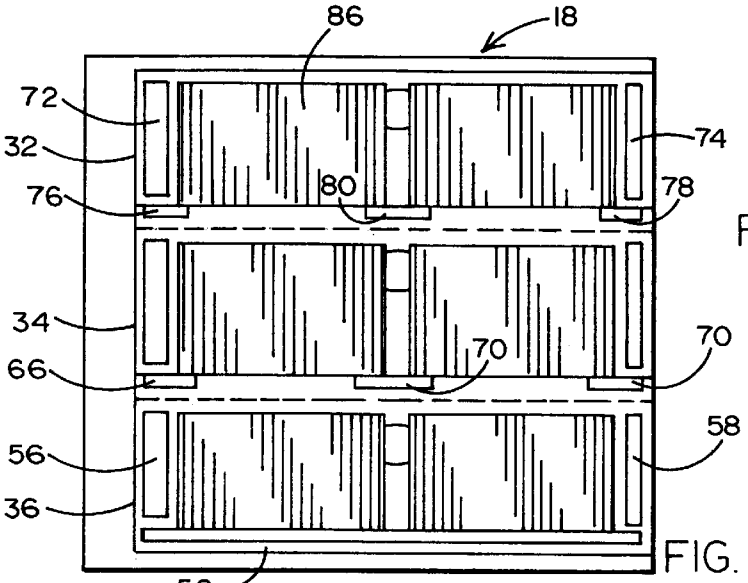

FIG. 4 shows how six photographs 86 of equal size can be inserted into the album page 18. This is an illustration of the display of standard 4" by 6" photographs in horizontal orientation. A pair of photographs is inserted side-by-side into the pocket formed by transparent panel 36 from the top. The adhesive dot 60 is released and the two photos in the bottom row are put in place. They have end stops in the form of left and right adhesive bands 56 and 58. They have a bottom stop in the form of adhesive band 50. After the pictures are in place, the releasable adhesive dot 60 can be reattached to hold the upper corners of the two photographs in place. In the next upper row, two equal sized photographs are inserted under panel 34 by insertion behind the free top edge of the panel. The releasable adhesive 82 is open for this purpose. This pair of pictures rests between the end stops 62 and 64 and rests upon the bottom stops 66, 68 and 70. Thus, they are maintained in position. The pressure-sensitive adhesive 82 can be reattached when the pictures are in place. In a similar manner, the upper pair of photographs 86 are inserted behind the open top edge of panel 32. These pictures are engaged between the left and right adhesive bands 72 and 74 and rests on stops 76, 80 and 78. In this way, the pictures 68 are retained in position.

Figure 5:
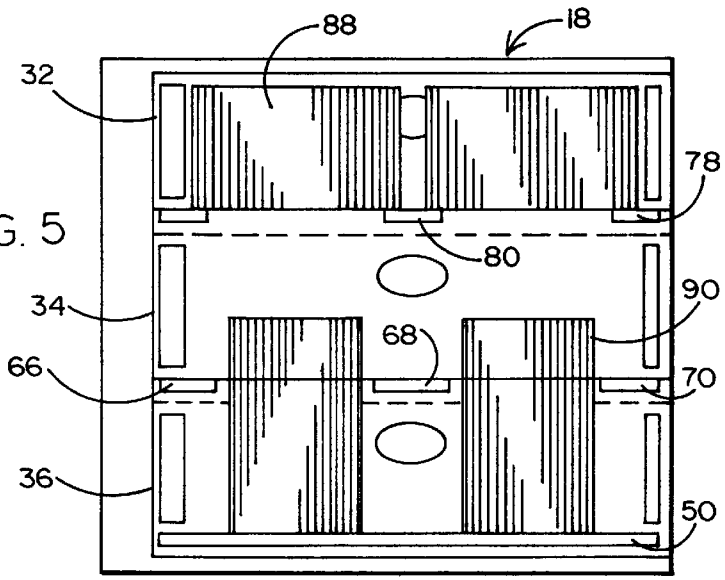
FIGS. 4, 5, 6, 7, 8 and 9 are plan views of the photograph album page of FIG. 2, showing different possible arrangements of photographs stored within the album page.

In FIG. 4, it is presumed that each of pictures 68 is correctly positioned when in the horizontal orientation. FIG. 5 illustrates how the pair of photographs 88 are positioned in the horizontal orientation and a pair of photos 90 are positioned in the vertical orientation. The 4" width of a standard 4" by 6" photograph in the vertical orientation fits between the stops 66 and 68 and between stops 68 and 70. The photographs 88 are inserted behind the panel 32 and are held in the same position as described with respect to the upper row in FIG. 4. The leftmost of the pair of photographs 90 in FIG. 5 is positioned between the stops 66 and 68 and rests upon the bottom band of adhesive 50. The right-hand of the pair of photographs 90 is inserted behind the top edge of panel 34 and is moved down by and below panel 36 to rest on the adhesive band 50 which acts as its bottom stop. It is positioned between the intermediate stops 68 and 70. The releasable pressure-sensitive adhesive spots can be reattached after all the photographs are in position. FIG. 5 thus illustrates a manner in which photographs of the same aspect ratio but of different orientation can be placed within and secured within the photograph album page 18.

Figure 6:
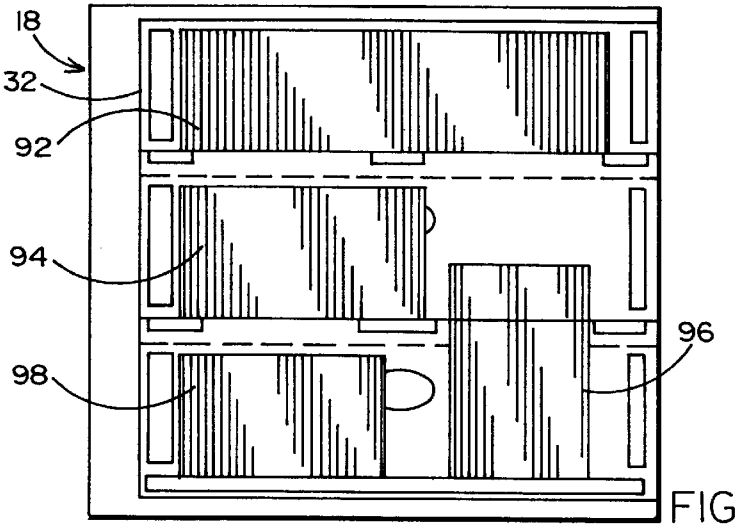

FIG. 6 illustrates how pictures of different aspect ratios and different orientations may be placed within the page 18 for display therein. Photograph 92 is a horizontal panoramic photograph which is usually 4" by 11". It lies behind the panel 32. It rests between the left and right adhesive bands and rests on all of the adhesive band stops 76, 78 and 80 which attach selected portions of the lower edge of the panel 32 to the backing panel. Photograph 94 is the standard 4" by 6" size. Photograph 94 is displayed in the horizontal position. Photograph 96 may be a hi-vision 4" by 7" size and is displayed in the vertical position. Photograph 94 rests upon the stops 66 and 68 while photograph 96 extends between stops 68 and 70 and rests upon the bottom adhesive band 50. Photograph 98 may be of the same size as photograph 94 because there is sufficient size for such in the display space it occupies. However, photograph 98 is in the horizontal position and is slightly smaller than photograph 94. The reattachable adhesive spots 82 and 60 can be attached to retain the transparent panels in place.

Figure 7:
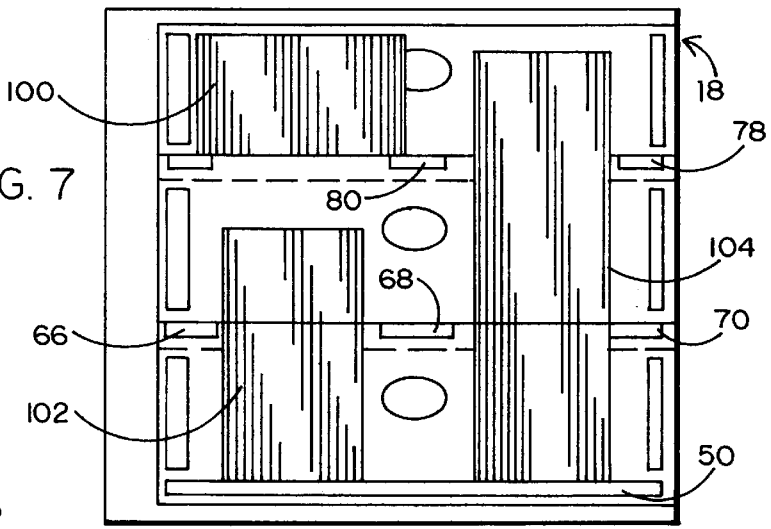

FIG. 7 shows another display utilization of the page 18. It shows standard 4" by 6" photo 100 in a horizontal position and it shows hi-vision 4" by 7" photograph 102 and panoramic 4" by 11" photograph 104 in a vertical position. The photograph 104 is a tall, narrow photograph and lies behind all three of the panels 32, 34 and 36. It is introduced into the page behind the top edge of panel 32 and is inserted downwardly between the 78 and 80 as well as between the bottom stops 68 and 70. It comes to a rest on the bottom adhesive band 50. In this way, tall photographs can be introduced, stored and displayed behind all three panels. Similarly, photograph 102 is introduced behind the top edge of the middle panel 34 and moved downwardly between stops 66 and 68 to rest on the bottom stop band 50.

Figure 8:
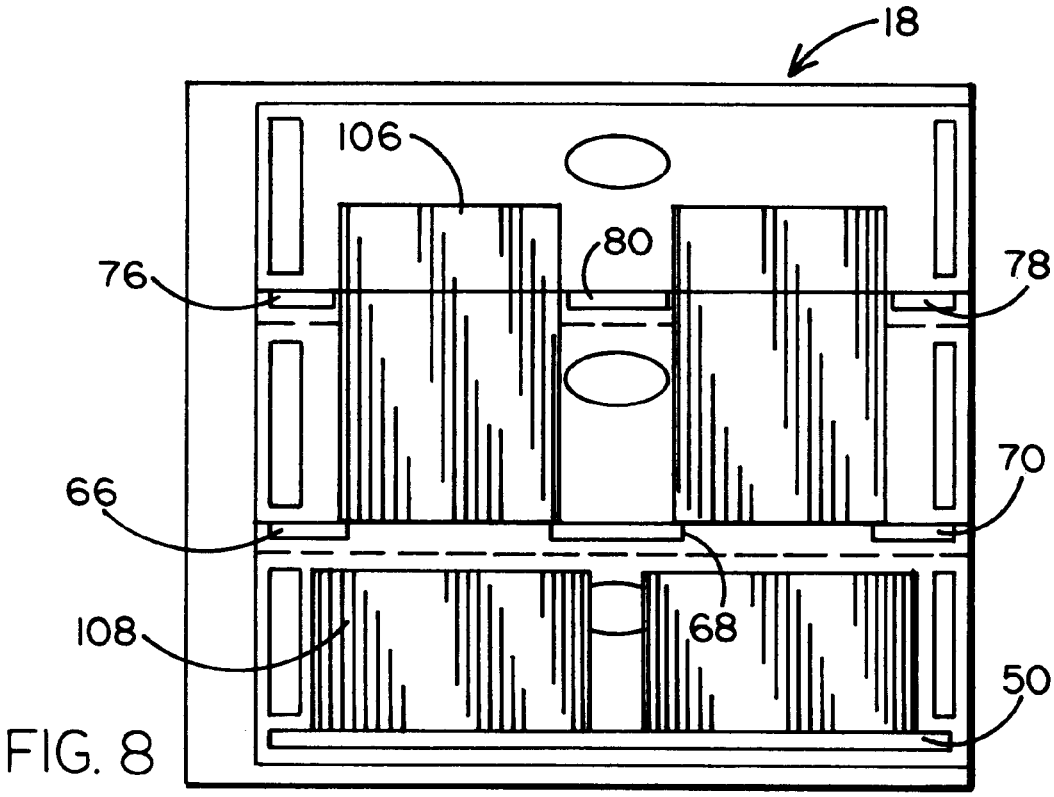

Other arrangements of photographs within the page 18 are also possible. In FIG. 8, the leftmost of a pair of 5" by 7" photos 106 is introduced behind the top edge of panel 32. The spacing between stops 76 and 80 and between stops 80 and 78 is larger than the distance between the stops 66 and 68 and stops 68 and 70. When the photograph 106 is introduced downward behind the panel 32, it passes between the stops 76 and 80 and engages upon the stops 66 and 68. This holds it in position. Similarly, the right of the pair of photographs 106 is introduced down behind the top edge of panel 32 and between the stops 78 and 80. It engages on the stops 68 and 70 to hold it in position. The lower pair of photos 108 can be introduced behind the top edge of the panel 34 and moved down to engage upon the bottom stop band 50. When the photographs are in place, the pressure-sensitive adhesive spots can be reattached to hold the photographs in position.

Figure 9:
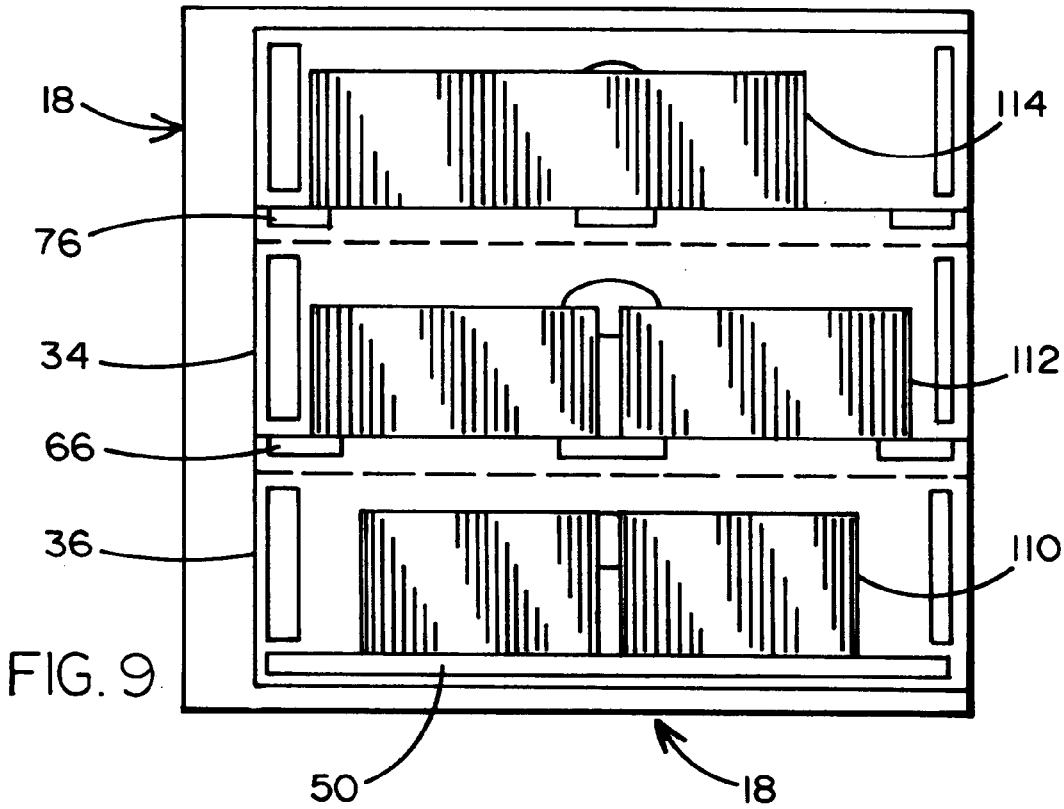

FIG. 9 illustrates another manner in which the album page 18 can be used to display photographs of different sizes. Smaller standard sizes include 2 ¼" by 3 ¼" and 3" by 4". There are also different standard sizes in other countries. For example, Japan utilizes 3" by 6" and 3" by 10" as standard sizes. The two horizontal photographs 110 are slipped in under the free top opening of transparent panel 36. They rest on the bottom permanent adhesive strip 50 which acts as the bottom stop when they are in the horizontal orientation. Also, in the horizontal orientation is the pair of photographs 112. The pair of photographs 112 is wider and the photographs rest upon the bottom stops 66, 68 and 70 which are the bottom stops which attach the bottom of panel 34. The top photo 114 is a panoramic photo in the horizontal orientation. It is inserted through the open top of panel 32 and rests upon the bottom stops 76 and 80 which attach the bottom edge of panel 32 to the central panel 28.

It is to be noted that the stops 76 and 78 are the same as but are a slightly shorter length in the horizontal direction than the stops 66 and 70, to leave more space therebetween. The stop 68 is wider than the stop 80. This means that a photograph of a width suitable to just pass between the stops 76 and 80 will engage on the top of stops 66 and 68. This is also true of the space between stops 78 and 80. The space therebetween is greater than the space between stops 68 and 70.

Figure 11:
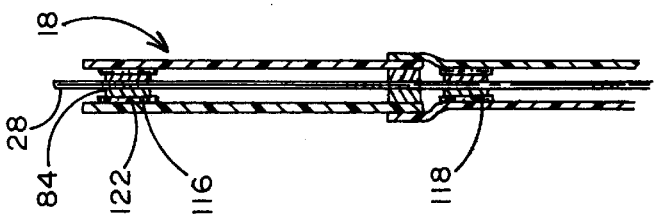
FIG. 11 is a section taken generally along line 11—11 of FIG. 10 showing a section including the applied label.
Figure 10:
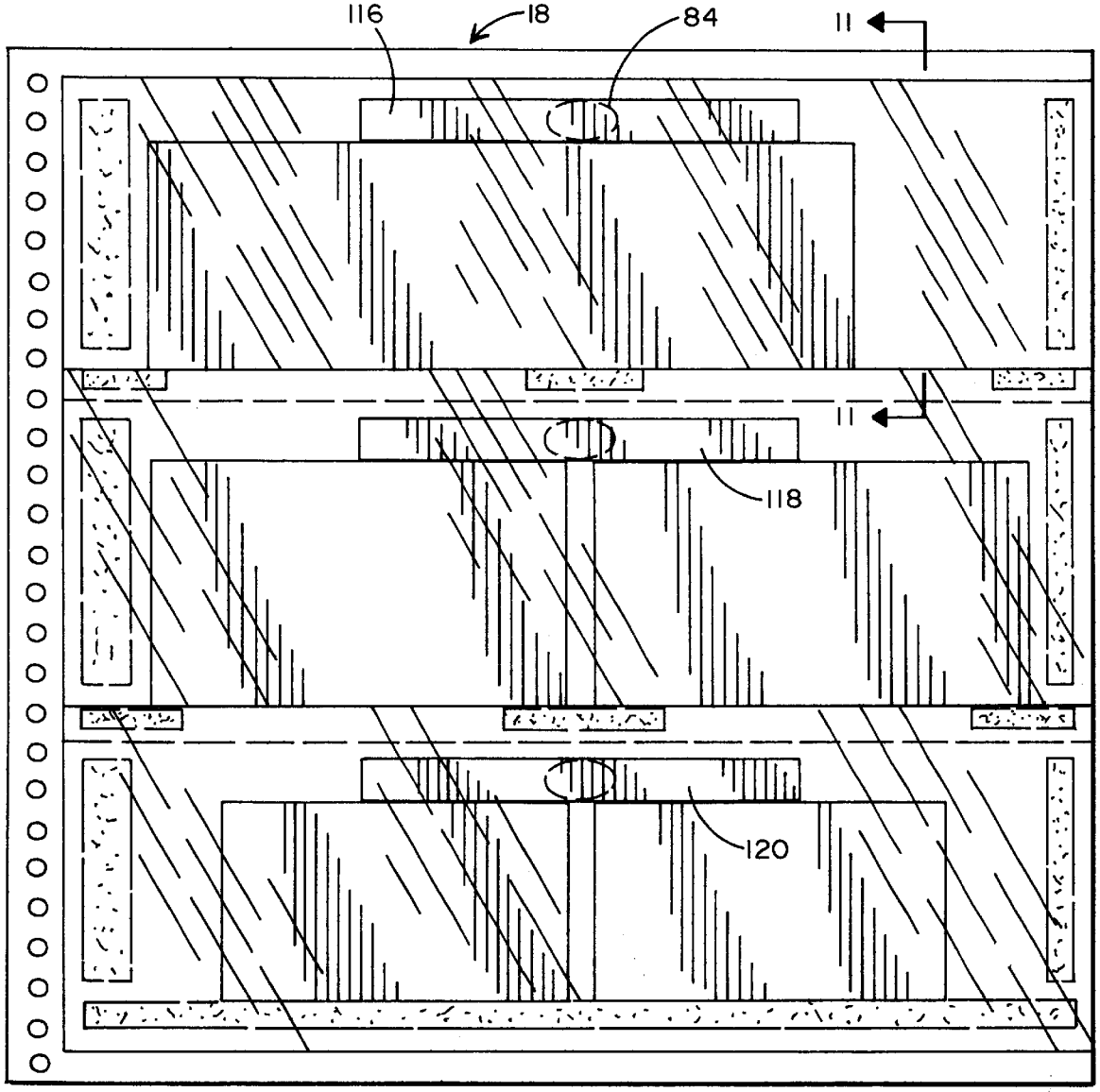
FIG. 10 is a plan view, similar to FIG. 2, showing the utilization of a label in connection with photographs sorted and displayed on the page.

FIGS. 10 and 11 show further views of the page 18, which has been described above. FIGS. 10 and 11 illustrate the position of labels 116, 118 and 120. These labels are provided for labeling the photographs. Each of the labels has a writing layer 122, which may be of paper or other material suitable for either writing or typing thereon of labeling information. When marked, the label is placed on one of the pressure sensitive adhesive dots 60, 82 or 84 to releasably hold it in place. Thus, a label can be removed when no longer relevant and may be relocated at another position where it may be relevant. As indicated in FIG. 11, there are labels on both sides of the center panel 28. The labels are optional and can be slipped in place after the photographs are put in place.

This invention has been described in its presently contemplated best mode and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A multi-purpose photograph album page comprising:

a central panel, an attachment structure on said central panel, said central panel having a height and a width;

at least first and second transparent polymer panels, said first and second transparent polymer panels each having a width substantially the same as the width of said central panel and having a height less than the height of said central panel, said first and second transparent panels being attached to said central panel, said first and second transparent panels being arranged so that said first panel is closer to the top of said central panel and said second transparent panel is closer to the bottom of said central panel with said second transparent panel overlapping the bottom of said first transparent panel, said second transparent panel being permanently attached adjacent its lower edge to said central panel adjacent its lower edge by an adhesive band to form a bottom stop and said second panel being attached adjacent its left and right edges to said central panel;

said first transparent panel being attached adjacent to its left and right edges to said central panel and being attached adjacent its bottom edge by three separate spaced bottom stop bands so that a photograph may be inserted behind said second transparent panel to lie against said bottom stop and another photograph may be inserted under said first transparent panel by insertion behind its top to rest against one or more of said spaced bottom stop bands or a photo may be inserted behind said first transparent panel to extend between said separate spaced bottom stop bands so that said photograph extends also behind said second transparent panel.

2. The multi-use page of claim 1 further including a detachable adhesive spot under each of said first and second transparent polymer panels adjacent the top center of each panel to detachably attach the tops of said transparent polymer panels to permit photographs to be positioned behind said panels.

3. The multi-use page of claim 1 wherein said page is double-sided with at least first and second transparent polymer panels attached to each side thereof.

4. A plurality of multi-use pages of claim 1 wherein each page has an attachment structure thereon so that said plurality of said pages may be bound together into an album.

5. The multi-use page of claim 4 further including a detachable adhesive spot under each of said first and second transparent polymer panels adjacent the top center of each panel to detachably attach the tops of said transparent polymer panels to permit photographs to be positioned behind said panels.

6. The multi-use page of claim 5 wherein said page is double-sided with at least first and second transparent polymer panels attached to each side thereof.

7. A multi-use page for a photograph album, said page comprising:

a central panel structure, attachment structure on said central panel for attaching said page together with other pages to form a photograph album, said central panel having a face, a top edge, a bottom edge, a left edge and a right edge, said attachment structure being adjacent one of said edges;

first, second and third transparent polymer panels attached to said face of said central panel, said first, second and third transparent polymer panels each having a top edge, a bottom edge, a left edge and a right edge, said first panel being attached to said central panel adjacent said top edge and right edge of said central panel, said first transparent polymer panel being attached to said central panel by means of left and right permanent adhesive bands adjacent said left and right edges of said first panel, said left and right adhesive bands being also attached to said central panel, left, center and right adhesive bands between said first transparent polymer panel adjacent the bottom edge thereof and said central panel to attach the bottom edge of said first transparent polymer panel to said central panel, said left, center and right adhesive bands forming left, center and right stops, the top edge of said first transparent polymer panel being not permanently attached so that photographs can be slipped behind the top edge of said first transparent polymer panel to rest against said stops to be displayed behind said first transparent polymer panel;

said second transparent polymer panel being positioned between said top edge and said bottom edge of said central panel, a portion of said second transparent polymer panel overlying the bottom edge of said first transparent polymer panel, said second transparent polymer panel being attached by left and right permanent adhesive bands to said central panel and being permanently attached to said central panel by left, center and right spaced adhesive band stops adjacent the lower edge of said second transparent polymer panel, said left, center and right adhesive stops being spaced from each other; and said third transparent polymer panel being permanently attached to said face of said central panel by left and right bands adjacent said left and right edges of said third transparent panel, so that said third transparent polymer panel overlies the bottom edge of said second transparent polymer panel, said third transparent polymer panel being attached along its bottom edge adjacent said bottom edge of said central panel by means of a permanent adhesive band so that photographs may be inserted behind said second transparent polymer panel and behind said third transparent polymer panel for display.

8. The multi-use page of claim 7 wherein said stops permanently attaching the bottom edge of said second transparent polymer panel are positioned more closely together than said stops permanently attaching the bottom edge of said first transparent polymer panel to said central panel.

9. The multi-use page of claim 7 further including a detachable and reattachable pressure-sensitive spot between said first transparent polymer panel and said central panel adjacent said top edge of said first transparent polymer panel to releasably retain the top edge of said first transparent polymer panel to said central panel.

10. The multi-use page of claim 7 wherein said central panel is double-sided and there is a face on each side of said central panel and there are said first, second and third transparent polymer panels on each face of said central panel.

11. The multi-use page of claim 7 further including a label releasably attached to said central panel behind said first transparent polymer panel for labeling photographs displayed behind said first transparent polymer panel.

12. The multi-use page of claim 11 wherein there is a releasable label behind each of said first, second and third transparent polymer panels for labeling photographs displayed behind each said polymer panel.

13. The multi-use page of claim 8 further including a detachable and reattachable pressure-sensitive adhesive spot between said first transparent polymer panel and said central panel adjacent said top edge of said first transparent polymer panel to releasably retain the top edge of said first transparent polymer panel to said central panel.

14. The multi-use page of claim 13 wherein said central panel is double-sided and there is a face on each side of said central panel and there are said first, second and third of said transparent polymer panels on each face of said central panel.

* * * * *